US005186345A

United States Patent [19]

Ching An

[11] Patent Number: 5,186,345

[45] Date of Patent: Feb. 16, 1993

[54] CONTAINER

[76] Inventor: Chiang Ching An, P.O. Box 82-144, Taipei, Taiwan

[21] Appl. No.: 874,810

[22] Filed: Apr. 28, 1992

[51] Int. Cl.[5] ..... B65D 43/20

[52] U.S. Cl. ..... 220/23.4; 220/350; 220/23.6; 206/468; 206/509

[58] Field of Search ..... 220/23.4, 23.6, 23.83, 220/23.86, 245, 350, 23.6; 200/468, 509

[56] References Cited

U.S. PATENT DOCUMENTS

| | | | |
|---|---|---|---|
| 2,692,298 | 10/1954 | Waterman | 220/350 |
| 3,316,656 | 5/1967 | Wahl | 220/350 |
| 4,165,812 | 8/1979 | Jennison | 220/23.4 |
| 4,234,087 | 11/1980 | Pandak | 220/23.4 |
| 4,437,566 | 3/1984 | Szahler | 206/468 |
| 4,544,063 | 10/1985 | Neward | 206/540 |
| 4,627,532 | 12/1986 | Clemens | 206/350 |
| 4,997,103 | 3/1991 | Daly | 220/350 |

*Primary Examiner*—Joseph Man-Fu Moy
*Attorney, Agent, or Firm*—Alfred Lei

[57] ABSTRACT

This invention relates to a container and in particular to one which mainly includes a body portion having a space provided with a first elongated member at the left side and a second elongated member at the right side on which there are a plurality of holes, a gate inserted into the groove of the first elongated member and having a projection on one end by means of which the cover may be moved to go along the curved groove to open or close the container, and a top cover having a plurality of pins adapted to engage with the holes of the body portion and a curved groove at the inner side to receive the upper edge of the cover, whereby similar containers may be horizontally or vertically connected together.

2 Claims, 4 Drawing Sheets

CONTAINER

BACKGROUND OF THE INVENTION

It is found that there are various kinds of containers on the market, but only a few of them can be joined together so as to make it easier to be stowed or the like. Nevertheless, they are not satisfactory in use.

Therefore, it is an object of the present invention to provide a container which may obviate and mitigate the above-mentioned drawbacks.

SUMMARY OF THE INVENTION

This invention relates to a container.

It is the primary object of the present invention to provide a container which may be horizontally or vertically connected together.

It is another object of the present invention to provide a container which is compact in size.

It is still another object of the present invention to provide a container which is simple in construction.

It is still another object of the present invention to provide a container which is economic to produce.

It is a further object of the present invention to provide a container which is economic to manufacture.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
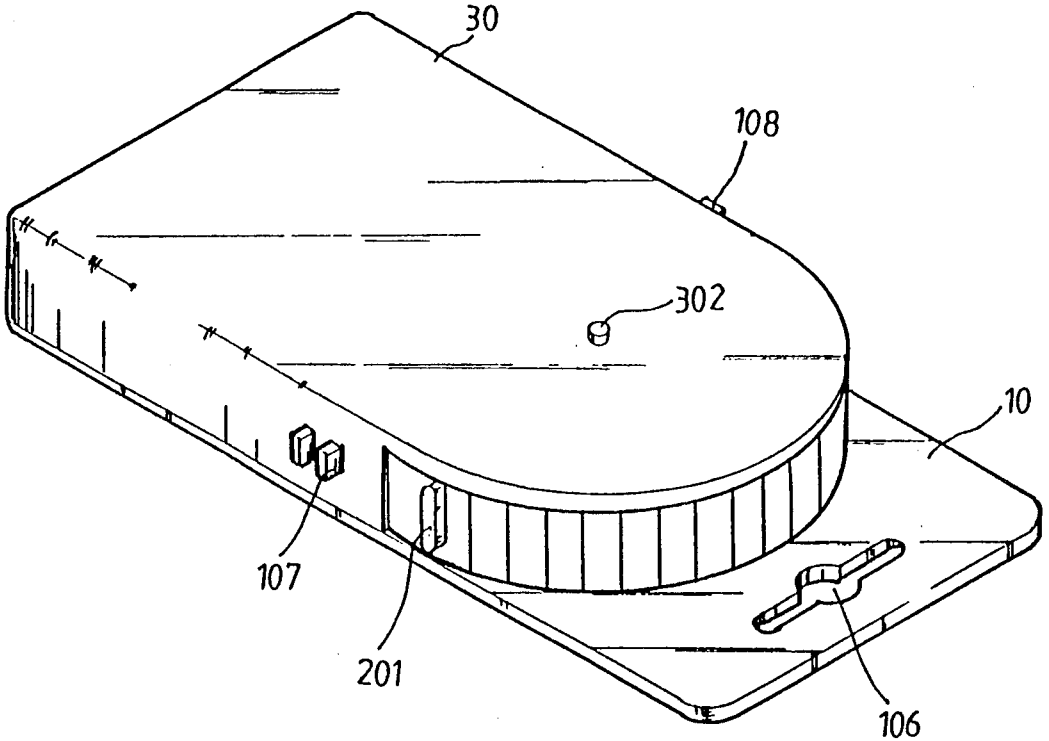
FIG. 1 is a perspective view of a container according to the present invention.
Figure 2:
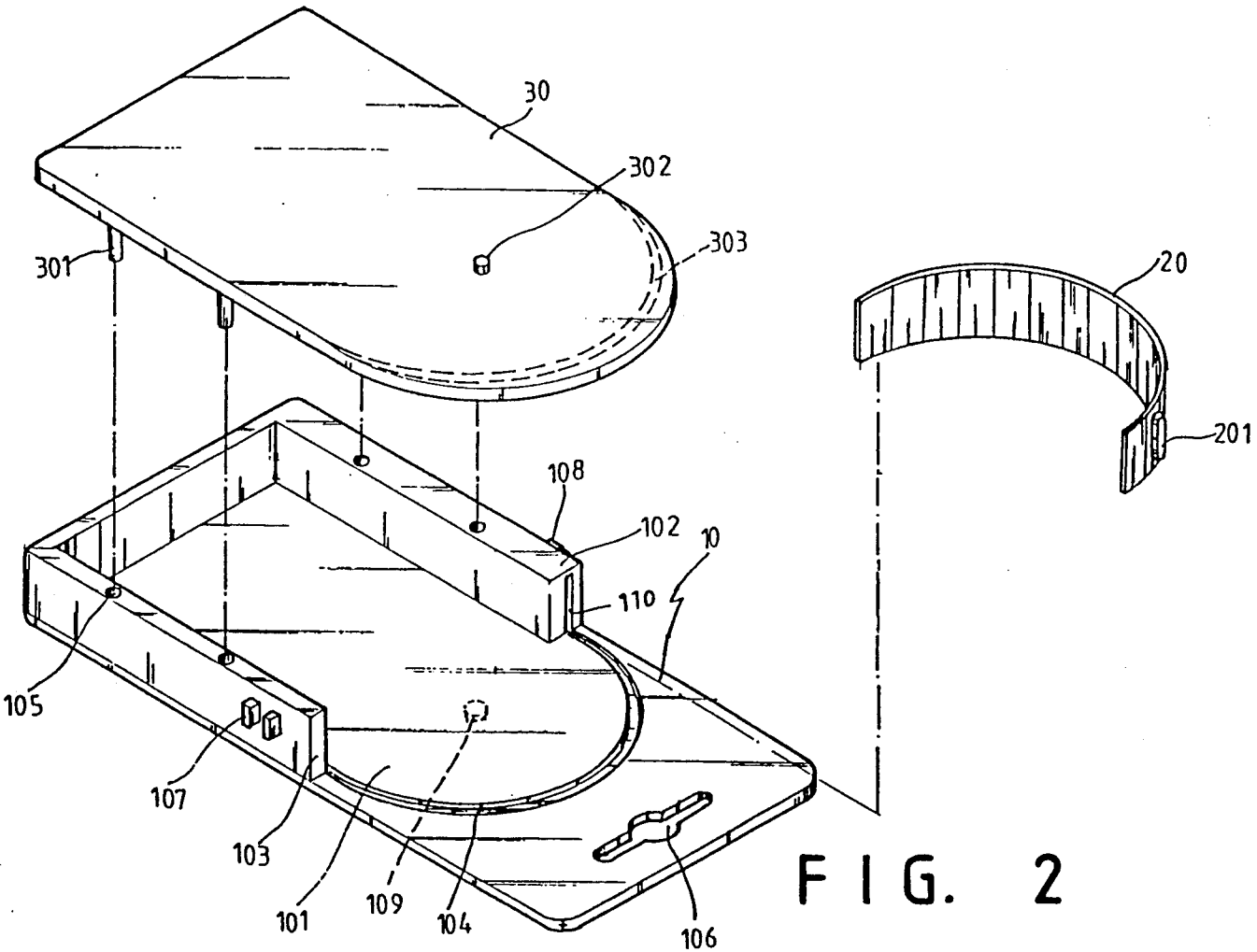
FIG. 2 is an exploded view of the container.
Figure 3:
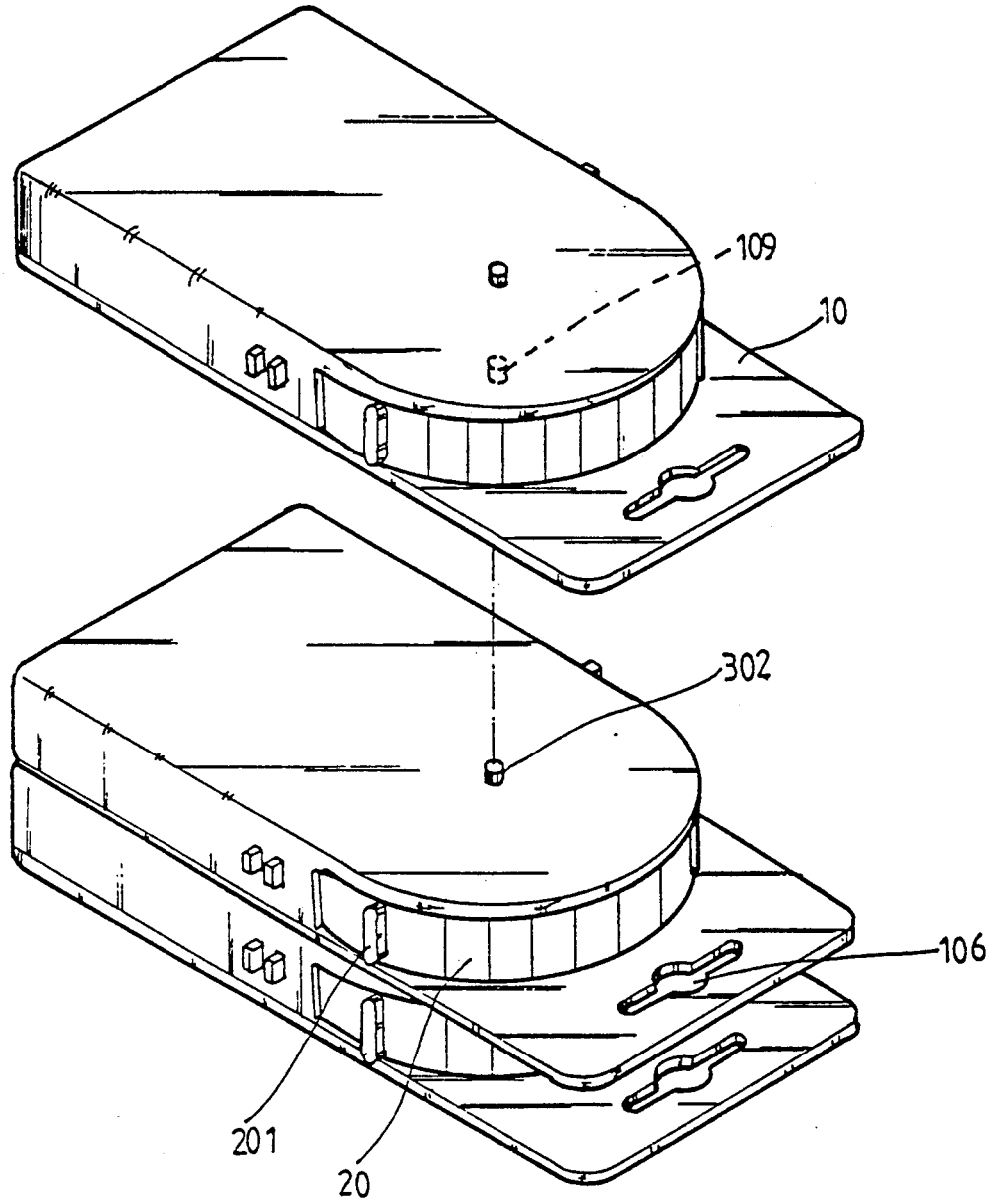
FIG. 3 shows how the containers are vertically connected together.
Figure 4:
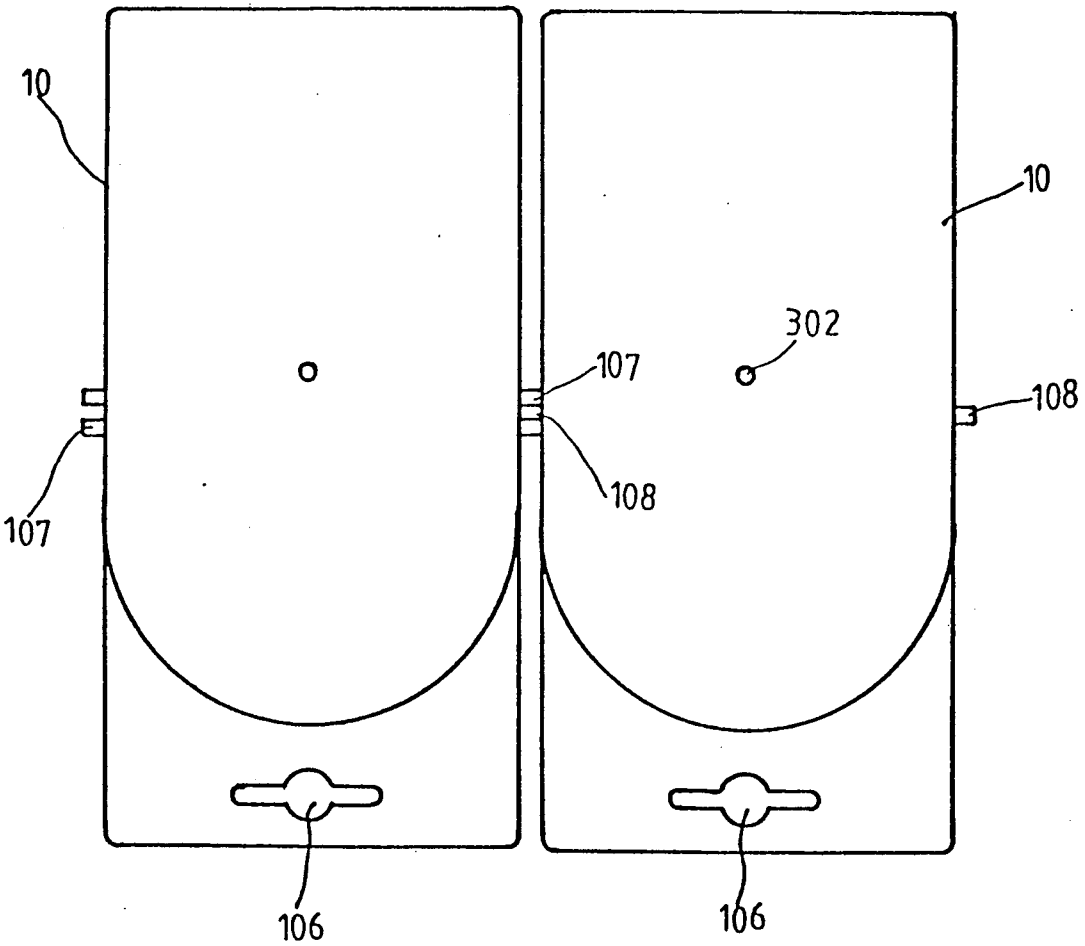
FIG. 4 shows how the containers are horizontally connected together.

With reference to the drawings and in particular to FIGS. 1 and 2 thereof, the container according to the present invention comprises a body portion 1 which has a space 101 for receiving articles. The space 101 is provided with a first elongated member 102 at the left side and a second elongated member 103 at the right side (with respect to FIG. 2) on which there are a plurality of holes 105. The first elongated member 102 is formed with a groove 110 in its interior. A curved groove 104 extends from the groove 110 of the first elongated member 102 to the second elongated member 103. A slot 106 is provided on the top side of the body portion 1. The first elongated member 102 is provided with a protuberance 108 at the outer vertical side while the second elongated member 103 with two protuberances 107 at the outer vertical side so that the protuberance 108 of a container according to the present invention may be snug-fitted between the two protuberances 107 of another container according to the present invention.

Further, the body portion 1 is provided with a circular recess 109 on the bottom side.

A gate 20 is inserted into the groove 110 of the first elongated member 102 and has a projection 201 on its one end. By means of the projection 201, the gate 20 may be moved to go along the curved groove 104 to open or close the container.

A top cover 30 is provided with a plurality of pins 301 adapted to engage with the holes 105 of the body portion 1. In addition, the inner side of the top cover 30 portion 1 has a curved groove 303 adapted to receive the upper edge of the cover 20. Furthermore, the upper surface of the top cover 30 is provided with a protuberance 302 adapted to the circular recess 109 on the bottom side of the body portion 1 so that the containers according to the present invention may be vertically connected together.

Although the present invention has been described with a certain degree of particularity, it is understood that the present disclosure is made by way of example only and that numerous changes in the detail of construction and the combination and arrangement of parts may be resorted to without departing form the spirit and scope of the invention as hereinafter claimed.

I claim:

1. A container comprising:

a body portion having a space provided with a first elongated member at a left side and a second elongated member at a right side on which there are a plurality of holes, said first elongated member being formed with a groove in the interior, said body portion further having a curved groove extending from the groove of said first elongated member to said second elongated member and a slot provided on a top side, said first elongated member being provided with a protuberance at an outer vertical side while said second elongated member with two protuberances at an outer vertical side so that the protuberance of the first elongated member of said container may be snug-fitted between two protuberances of a second elongated member of another container thereby enabling similar containers to be horizontally connected together;

a cover inserted into the groove of said first elongated member and having a projection on one end by means of which said cover may be moved to go along said curved groove to open or close said container;

a top cover having a plurality of pins adapted to engage with the holes of said body portion and a curved groove at an inner side to receive an upper edge of said cover.

2. The container as claimed in claim 1, wherein said body portion is provided with a recess on a bottom side and said top cover has a protuberance on an upper surface which is adapted to said recess so that said container may be vertically connected with another similar container.

* * * * *